United States Patent [19]

DePerna

[11] Patent Number: 4,941,662

[45] Date of Patent: Jul. 17, 1990

[54] BASEBALL GAME

[76] Inventor: James DePerna, P.O. Box 665, Landing, N.J. 07850

[21] Appl. No.: 270,091

[22] Filed: Nov. 14, 1988

[51] Int. Cl.[5] ..... A63C 69/00

[52] U.S. Cl. ..... 273/25; 272/3

[58] Field of Search ..... 273/26 A, 371, 26 R, 273/29 A, 25, 410, 411, 88, 90, 93 R, 185 R, 55 R; 272/3

[56] References Cited

U.S. PATENT DOCUMENTS

| | | | |
|---|---|---|---|
| 4,563,005 | 1/1986 | Hand et al. | 273/371 |
| 4,733,865 | 3/1988 | Reed | 273/26 A |
| 4,763,903 | 8/1988 | Goodwin et al. | 273/371 |

*Primary Examiner*—T. Brown

*Attorney, Agent, or Firm*—Thomas L. Adams

[57] ABSTRACT

A baseball game played with a bat and a pitched ball includes a ball detection system, a scoring device and a plurality of ball sensing field zones. The ball detection system is located near a batting position for providing a passage signal in response to passage of said ball through said batting position. Ball sensing field zones are spaced from and face the batting position for intercepting the ball. Each ball sensing field zone provides, in response to ball penetration, a zone signal signifying the position of the ball. The position corresponds to a hit, foul or out. The scoring device is coupled to the ball detection system and ball sensing field zones for registering a hit, foul, or out in response to the zone signal, following production of the passage signal.

16 Claims, 2 Drawing Sheets

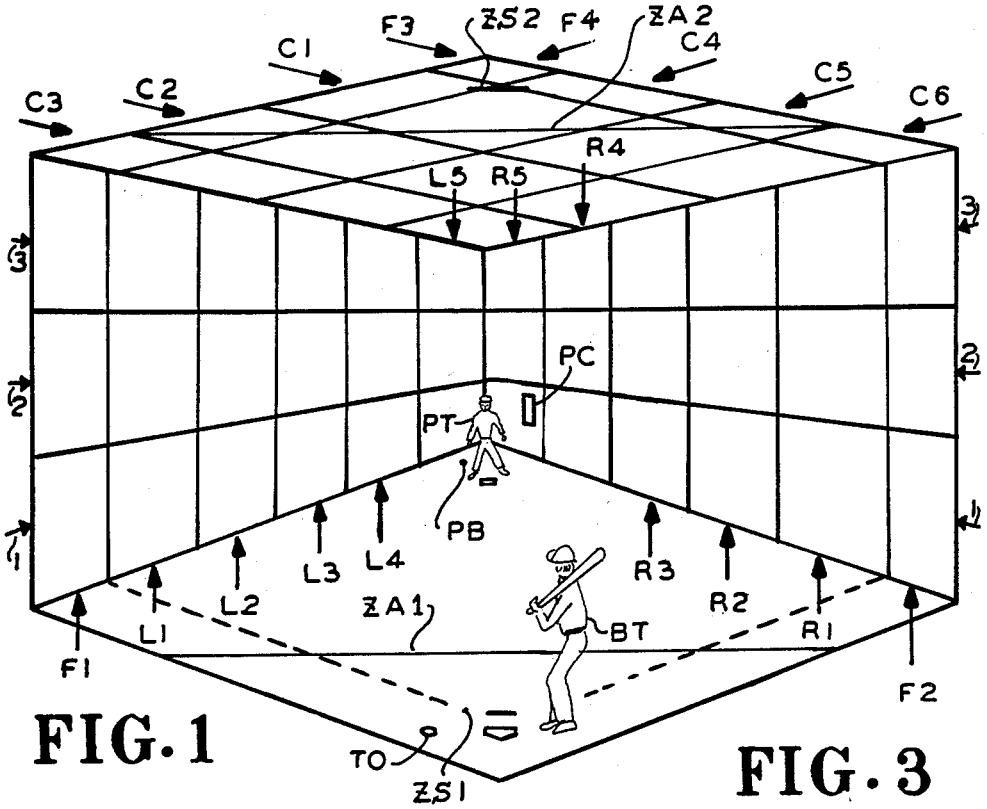
FIG. 1
FIG. 3
FIG. 2
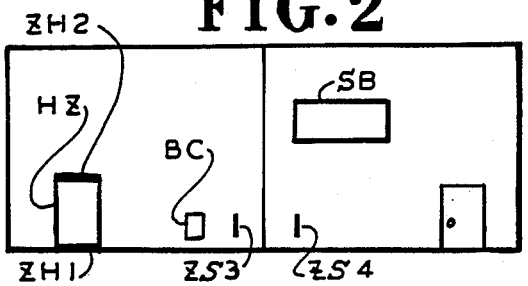
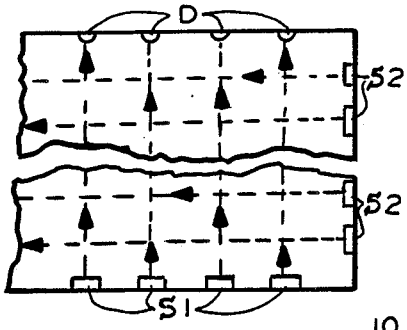
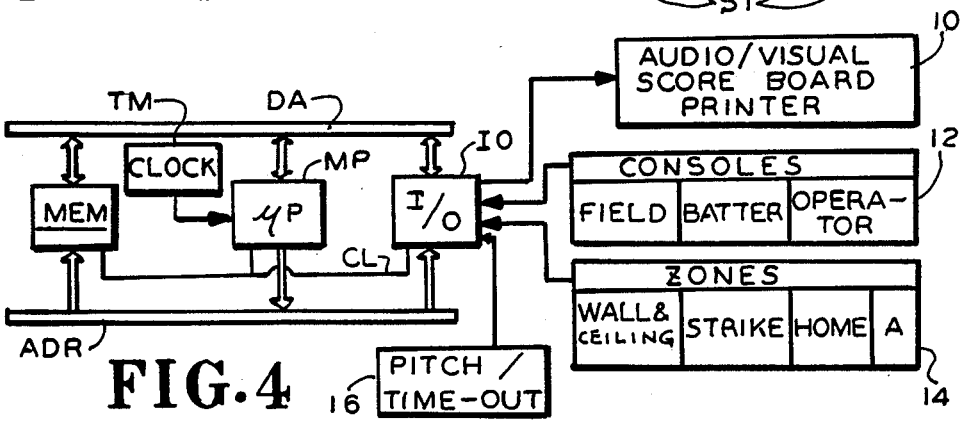
FIG. 4

BASEBALL GAME

BACKGROUND OF THE INVENTION

The present invention relates to a baseball game, and in particular to a game played with ball detection equipment.

It is known to use ball detectors to evaluate the performance of a player and to allow practice by simulation. For example, a known apparatus evaluates a pitched ball with a double row of light sensors. The sensors are numerous enough to determine the ball position in three dimensions so that location and speed can be evaluated (U.S. Pat. No. 4,563,005). This device, however, is not arranged to allow batting practice, evaluate the performance of a batter, or play an actual game.

Other equipment uses optical detectors to determine the characteristics of a batter's swing (U.S. Pat. Nos. 3,531,116; 4,461,477 and 4,708,343). These latter devices evaluate a batter's swing without actually using a pitched ball.

Other practice and evaluation devices have been limited to evaluating or providing practice for a single player. For example, devices have been developed to determine the force of impact of a football (U.S. Pat. No. 4,029,315) or the angle of rebound of a golf ball (U.S. Pat. No. 3,837,655). Neither of these references allow practice for both a batter and pitcher since they are limited to different sports and are intended for single player use.

Another system suited for a single player (U.S. Pat. No. 4,070,018) employs a mechanical ball server. A player returns the ball and a plurality of vertical panels detect impact strength and the location where the ball is returned by the player. This system, however, does not have any means for evaluating the ball being served by another player, does not accept strategic input, and does not accommodate the many facets, actions and rules associated with the game of baseball. See also U.S. Pat. Nos. 3,618,957; 4,545,576, and 4,673,183.

Accordingly, there is a need for a single and multiplayer baseball game that not only detects the location of the pitched ball and the destination of the hit ball, but challenges the mental, as well as the physical, abilities of participants, both offensively and defensively. The result is a baseball game that is more exciting and realistic than its predecessors.

SUMMARY OF THE INVENTION

In accordance with the illustrative embodiments demonstrating features and advantages of the present invention, there is provided a baseball game played with a bat and a pitched ball. The game includes a ball detection means, a zone detection means, and a scoring means. The ball detection means is located about a batting position for providing a passage signal in response to passage of said ball through the batting position. The zone detection means can define a plurality of ball sensing field zones. These ball sensing field zones are spaced from and face the batting position for intercepting the ball and providing in response thereto a zone signal. The zone signal signifies the position of the ball. This zone signal corresponds to a position signifying a hit, foul, or out. The scoring means is coupled to the ball and zone detection means for registering a hit, foul or out in response to the zone signal, following production of the passage signal.

By employing such apparatus, an improved baseball game is achieved. In a preferred embodiment, the game may be played in a room having a batting and pitching position near opposite corners. The two walls facing the batting position and the ceiling may have a plurality of ball sensing field zones. Preferably, the apparatus includes ball detectors at the batting position to detect the ball arriving and leaving the batting position; as well as a strike zone detector to determine whether a pitched ball arrived within the strike zone or a bat was swung through the strike zone.

With this equipment, the timing of the hit ball can be determined. If the ball arrives and then timely leaves the batting position, a scoring computer can assume that a ball has been hit. Then, the portion of the wall or ceiling struck by the batted or fielded ball is determined by the various ball detectors that monitor the surface areas of the ceiling and the opposite walls.

With such equipment, the pitched ball and the hit ball, as well, can be evaluated. The hit ball can be evaluated in two ways. As mentioned, the location where the ball strikes the ceiling or opposing walls is determined. Furthermore, the speed of the ball can be evaluated since the time when the ball leaves the batting position and the time when the ball strikes a wall or ceiling is determined as well.

In a preferred embodiment, various accessories are provided such as consoles for the batter, pitcher and an official. The apparatus can include a pitch button so that the computer knows when a pitch is about to be delivered and thus register the pitched ball or excessive delay in the arrival of the pitched ball. A time-out button may be provided near the batting position to place the system in standby. Also, in a preferred embodiment, a "home zone" is provided near the batting position. The home zone includes a ball detector and may be used by the fielding team for pitch-outs, walking a batter or for throwing a ball to what is considered an alternate out position.

By employing equipment of the foregoing type, a highly interesting game can be played that realistically duplicates the dynamics of an actual baseball game. The game can be played with two or more players or, with the incorporation of an optional pitching machine, a single player may engage in an individual game of skill. Strategies can be implemented in that fictitious fielders can be electronically placed at selected positions so that the significance of hitting a ball to a certain position changes according to chosen strategies.

BRIEF DESCRIPTION OF THE DRAWINGS

The above brief description, as well as other objects, features and advantages of the present invention, will be more fully appreciated by reference to the following detailed descriptions of the presently preferred but nonetheless illustrative embodiment in accordance with the present invention when taken in conjunction with the accompanying drawings wherein:

FIG. 1 is a perspective view of a baseball game set up in accordance with the present invention;

FIG. 2 is a development showing the two walls adjacent to the batting location illustrated in FIG. 1;

FIG. 3 is a schematic illustrating the preferred ball detection and zone detection means of FIG. 1;

FIG. 4 is a block schematic diagram of a scoring means which is used in conjunction with the baseball game of FIG. 1.

DETAILED DESCRIPTION OF THE PREFERRED EMBODIMENT

Figure 5:
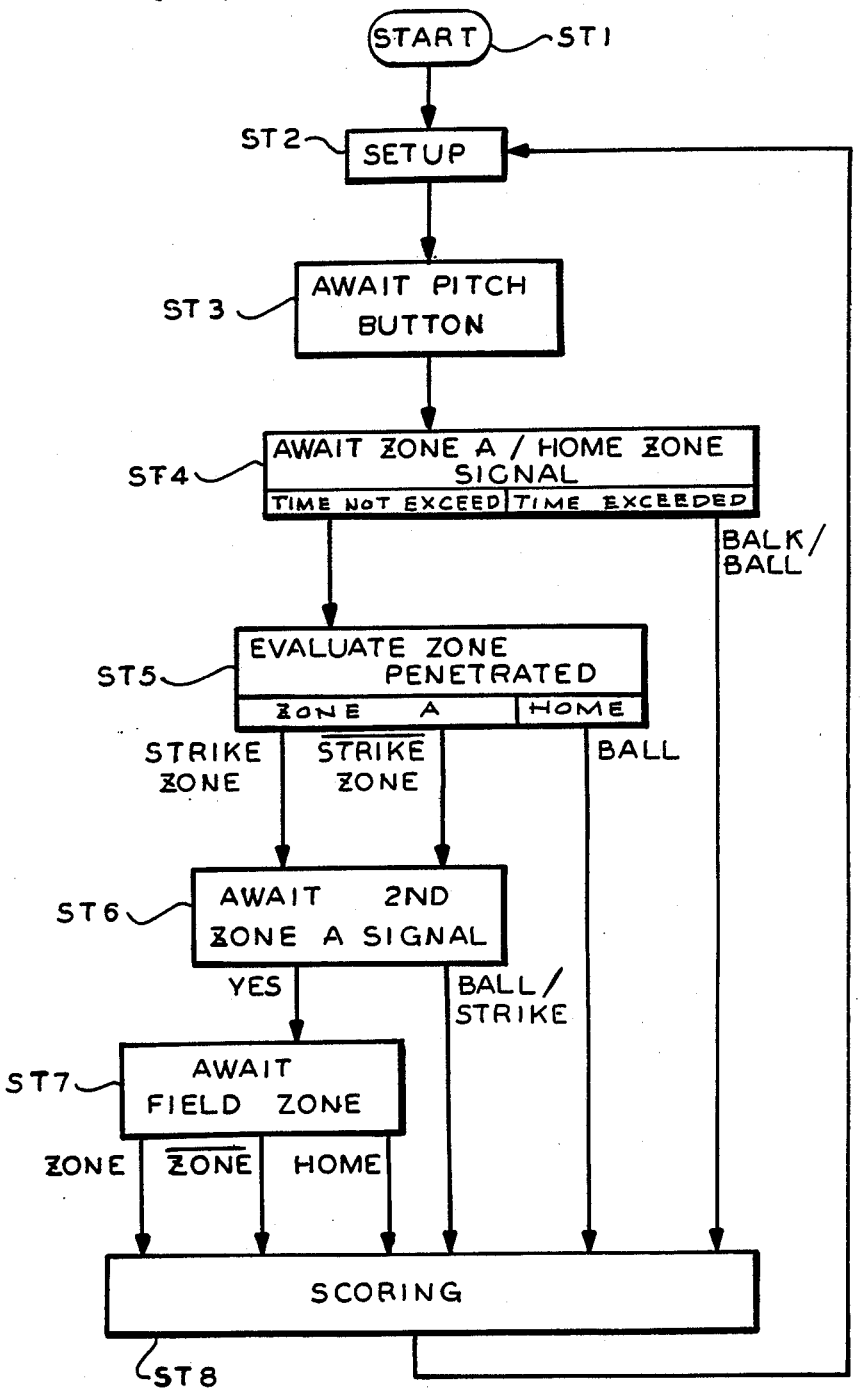
FIG. 5 is a flowchart illustrating the function performed by the microprocessor of FIG. 4.

Referring to FIG. 1, a perspective view of a baseball game is shown. The game is being played in a room where batter BT is at a batter's position and pitcher PT at a pitching position, near opposite corners of the room. The left wall facing batter BT is composed of six columns, Fl and L1–L5. This wall is further divided by rows 1,2,3 so that a grid is defined so that each position has a coordinate. For example, the lower left grid element is defined as element F1,1. Similarly, the right wall facing batter BT is composed of three rows 1, 2 and 3 and six columns identified as columns F2 and R1–R5. For example, the upper left grid element is identified as element R5,3. In a similar fashion, the ceiling is divided into four rows and columns, the columns parallel to the left wall are identified as columns F3, C1, C2 and C3, in that order. The outermost column, furthest from batter BT, is column C3. The rows are identified as row F4 and rows C4, C5 and C6, row C6 being the furthest from batter BT. The intersection of row F4 with column F3 is the rectangular ceiling sector closest to the batter BT. Accordingly, the ceiling is divided into a grid. The grid sectors closest and furthest from batter BT are identified as sector F3,F4 and sector C3, C6, respectively.

As will be explained in further detail hereinafter, the grid of elements in the walls facing batter BT are a plurality of ball sensing field zones operating as a first plurality of vertical detectors. The grid of the ceiling also consists of a plurality of ball sensing field zones, operating as a second plurality of horizontal detectors. As disclosed hereinafter, these detectors can be optical sensors although other types of sensor devices may be used instead.

A ball detection means, shown herein as region means ZA1 and ZA2, may employ a number of photodetectors, although other equipment may be used in different embodiments. The ball detection means ZA1 and ZA2 optically detects whether a ball pitched by pitcher PT has passed into the batting location by penetrating the plane defined as the plane intersecting both lines of elements ZA1 and ZA2.

Part of the ball detection means is shown as a strike means having four elements. Two are vertical elements provided through detectors ZS1 and ZS2 located in the floor and ceiling, respectively, of the playing room illustrated in FIG. 1. In FIG. 2, two horizontal elements are shown as zone sensors ZS3 and ZS4 which are also part of the strike means. In this embodiment, the photodetectors used in the other detectors are also used in zone sensors ZS1–ZS4, although other types of ball sensors can be used instead.

The physical arrangement of detection means is such that a pitched ball can be sensed as entering or leaving the batting position by its passing through the plane of detectors ZA1, ZA2. As described hereinafter, the horizontal and vertical position of a pitched ball can be detected by ball detection means ZS1–ZS4 so that a strike can be determined. The 36 wall positions and 16 ceiling positions can sense where a ball impacts. Thus certain of these locations can be defined as foul balls. For example, the following positions are foul: F1,1; F1,2; F1,3; F2,1; F2,2; F2,3; F3,F4; F3,C4; F3,C5; F3,C6; C1,F4; C2,F4; and C3,F4. As explained hereinafter, the other wall and ceiling positions can be correlated to a hit or an out, depending on defensive strategies which the players may elect in a manner to be described.

At the pitching position, pitch switch PB is mounted in the floor. Switch PB is used by the pitcher PT who activates switch PB just before pitching the ball. A time-out switch TO is located at the batting position. Batter BT can activate switch TO when he wishes to place the play in standby. A fielding console PC is shown at the pitching position near pitcher PT. The console will be used for purposes to be described presently.

In FIG. 2, a batting console BC is shown mounted on a wall adjacent to the batter, to be used for purposes that will be described presently. On the same wall, near batting console BC, is a zone shown here as a rectangular region HZ having ball sensing means ZH1 and ZH2 bordering its bottom and top, respectively. A ball thrown into home zone HZ is sensed to effect certain scoring decisions to be described presently. The other wall adjacent the batter is shown having a scoreboard SB to display the scoring results based on ball detectors, zone detectors and other input provided through the batting console BC and fielding console PC. It will be appreciated that a third console, defined as an operator console (not shown), can be made available to an official who may act as umpire.

The operator console allows an operator to administer the entire system, including game set-up, game updates and error correction. Before the start of a game, participant statistics, game parameters and any other important facts are entered into the computer through the operator console. Some game parameters include: names of players, player batting order, number of players per team, number of innings per game, number of outs per inning, type of ball used, and type of bat used.

Referring to FIG. 3, the structure employed for the zone and ball detection means of FIG. 1 is given in further detail. The apparatus of FIG. 3 may be used to detect the passage of a ball into the batting position (as determined by elements ZA1 and ZA2 of FIG. 1), a strike (elements ZS1–ZS4) or the position of a hit or thrown ball when it reaches a ceiling or a wall as illustrated in FIG. 1. A spaced plurality of light sources is shown herein as infrared light emitting diodes S1 and S2. These light sources may be evenly spaced with a spacing of about 2 inches, although other spaces may be employed, depending upon the desired accuracy and the size of the ball. Preferably, light sources S1 and S2 are spaced from the wall or other surfaces associated with the light sources so that the ball can penetrate through the light beams. The beams may be, for example, spaced from the nearest wall or ceiling by a dimension equivalent to the radius of the ball. It will be noted that the light beams of sources S1 perpendicularly cross the paths of the light beams of sources S2. The beams from sources S1 shine upon a spaced plurality of light sensors D spaced apart with the same spacing as light sources S1. (The sources S2 illuminate sensors as well but they are not illustrated herein.) Accordingly, the position of a ball can be measured with a resolution equal to the spacing between sources/detectors. In practice, detectors D will be connected in groups so that the position of the ball is defined within sectors of a grid, such as the grid shown for the walls and ceiling of FIG. 1.

In an embodiment where the three dimensional position of the ball need not be known, but the passage of the ball should be detected, only one parallel array of light beams is needed. The light beams need not be in a grid of orthogonal light beams. In a detecting means for detecting ball passage (for example, detectors ZA1 and ZA2 of FIG. 1) the horizontally directed light sources S2 could be eliminated. Thus light beams could pass vertically from sources S1 to intersect detectors D, without the need for further perpendicular beams.

Detectors D may be photo-transistors sensitive to infrared light, although in other embodiments photocells, photomultipliers, other radiation detecting equipment, or other motion sensing devices can be used instead. For example, impact sensors working with piezoelectric crystals, switches and other motion sensing equipment can be substituted in place of the aforementioned photo-transistor technology, depending upon the desired accuracy, simplicity of construction, etc.

Referring to FIG. 4, the scoring means is shown herein having a processing means MP connected between a data bus DA and an address bus ADR. Processing means MP is timed by timing means TM which may be a crystal-controlled oscillator. Processing means MP can be a type 8086 microprocessor from Intel or various other processors. Alternatively, a general purpose computer or other equipment can be used instead. Associated with processor MP is a memory means MEM also connected between data bus DA and address bus ADR. An output means IO is also connected between data bus DA and address bus ADR for providing input and output between microprocessor MP and the other devices illustrated in FIG. 4. A control line CL is connected between microprocessor MP, device MEM and input and output device IO.

The input/output devices connected to device IO are shown in block form. A printer and other audio visual displays are found in block 10. The previously mentioned scoreboard (scoreboard SB of FIG. 2) is also contained in block 10. The previously mentioned consoles (consoles PC of FIG. 1 and BC of FIG. 2) including previously mentioned operator's console, are contained in block 12. As previously mentioned, the detection means of FIGS. 1 and 2 have wall and optional ceiling field zones, a strike zone, a home zone HZ (FIG. 2) and a passage zone "A" (ball detection means employing elements ZA1 and ZA2). These ball and zone detectors are illustrated in block 14, also connecting to input/output device IO. The previously mentioned time-out button TO and pitch button PB (FIG. 1) are shown as outputs of block 16 connecting to input/output device IO.

To facilitate an understanding of the principles associated with the foregoing apparatus, the operation of the equipment of FIGS. 1–4 will be described in connection with the flowchart of FIG. 5. At the beginning of play, the participant(s) (in this case, two or more players) set up the game through the operator console or, if none is supplied, through either the fielding console PC or the batter console BC. The fielding team electronically positions itself; and sets the defensive strategies via the fielding team console PC (FIG. 1). The batting team, through console BC, sets baserunner strategy (only if at least one base is occupied by an imaginary runner). Play begins when the pitcher PT depresses pitch button PB (FIG. 1) and pitches the ball to the batter BT awaiting the pitch at home plate.

The flowchart of FIG. 5 illustrates that the computer initialization phase of step ST1 is followed by the set up phase ST2, in which the various strategies are established on the consoles.

The fielding team console PC (keyboard or keypad convenient to the fielding team) is used to enter the fielding team's defensive strategy for the ball that is about to be pitched to the batting team. Selections via the fielding team console must be made before the pitch button is activated (before the pitcher throws the ball to the plate). Should the fielding team not select a new defensive strategy before every pitch, the computer will assume that the previous defensive strategy is still in place. The fielding team console will control defensive strategies such as:

- Depth of Imaginary Outfielders (Deep, Normal, Short)
- Alignment of Outfielders (Shift Left, Shift Right, Normal, Guard the Lines)
- Depth of Imaginary Infielders (Normal, In, Double Play)
- Alignment of Infielders (Shift Left, Shift Right, Normal, Guard the Lines)

This console will also give players the opportunity to override the automatic scoring of the computer. There will be several instances in a typical game where the automatic scoring does not reflect actual events. For example, the wall and ceiling motion sensors cannot detect whether a player on the fielding team caught a batted ball before reaching a wall or ceiling field zone. Without instructions, a hit would be incorrectly scored by the computer MP. The manual override feature of the fielding team console eliminates incorrect scoring by allowing players to record occurrences such as strikes, fouls, balls, balks, hits and outs manually.

The batting team console BC, convenient to the batting team, is used to enter baserunning strategy for all imaginary runners on base. Selections via the batting team console must be made before the pitch button PB is activated by the fielding team. Should the batting team not select a new baserunning strategy before every pitch, the computer MP will assume that the previous baserunning strategy is still in place. The batting team console BC will control offensive strategies such as:

- Lead of Imaginary Runners (Small, Medium, Large)
- Attempt to Steal a Base (Yes, No)
- Attempt to Advance a Base on Outfield Fly (Yes, No)

Like the fielding team console, this console also allows for the override of automatic scoring. All overrides of automatic scoring for the previously pitched ball must be made before the pitch button PB is activated to signal the next pitched ball.

The microprocessor is shown awaiting the pitch button in step ST3. In step ST4, the travel time P of the pitched ball is clocked. The microprocessor MP establishes the elapsed time between the depression of the pitch button PB by the pitcher and the penetration of passage zone "A" (determined by elements ZA1 and ZA2 of FIG. 1) or alternatively penetration of the home zone HZ (FIG. 2). The elapsed time is measured in seconds or fractions thereof and is assigned to the value P. Value P has a preprogrammed maximum value of P1. When P exceeds P1, the pitch is declared to be a balk if imaginary runners are on base (a ball if no runners occupy the bases). If the pitcher violates P1 time constraints, microprocessor MP transfers control to step ST8, which is a scoring step, to perform the appropriate scoring decisions, calculations, and display thereof.

If the ball, however, timely penetrates passage zone "A" or the home zone, that timing is noted in step ST5. If home zone HZ (FIG. 2) has been penetrated, control is again transferred to step ST8 for the appropriate scoring.

The home zone HZ serves as an alternate target area for pitching or fielding purposes. Pitch-out and intentional walk pitches are targeted by the pitcher to the home zone HZ, along with any throws from the fielding team that are destined for an imaginary catcher at home plate. When the home zone is penetrated during a pitch, the computer records a ball. This zone, like passage zone "A", will stop the pitching time clock P.

If passage zone "A" has been penetrated, in step ST5 a determination is made whether the strike zone has been penetrated as detected by sensor set ZS1–ZS4. If it has been penetrated, such input is provided from input/output device IO (FIG. 4) through data bus BA to microprocessor MP. In step ST5, microprocessor MP clocks the elapsed time S between penetration of passage zone "A" by the ball and penetration of the strike zone by a ball or bat. Microprocessor MP imposes a preprogrammed maximum value S1 on the time S. In step ST6, a pitch is declared to be a ball when S exceeds S1 (pending the non-penetration of passage zone "A" for a second time). Conversely, a pitch is declared to be a strike when strike zone detectors ZS1–ZS4 have been triggered within S1 seconds (pending the non-penetration of passage zone "A" for a second time). In either situation, control is transferred to scoring step ST8 to register and display the ball or strike.

If, however, a second penetration of passage zone "A" timely follows the first, as detected by sensors ZA1–ZA2, control is transferred to step ST7. Step ST7 measures the time elapsing between the second penetration of passage zone "A" by a batted ball and the penetration of any wall or ceiling field zone by the ball. This elapsed time is a value assigned to a variable B and is registered upon the ball intersecting one of the wall or ceiling field zones (including home zone HZ). A reference variable Z is assigned a value to identify the field zone penetrated by the ball.

If the elapsed time value B exceeds a preprogrammed maximum value B1 (the fielding team was unable to field the ball and throw it into a favorable wall zone in a timely fashion), the batted ball is automatically declared to be a hit. The magnitude of the hit is determined by the microprocessor MP in step ST8. Whether the hit is declared a single, double, triple or home run depends on the magnitude of B (the time it took for the ball to naturally strike or be thrown into a field zone) and the value of Z (the field zone penetrated by the batted or thrown ball).

For some values of Z, depending on defensive strategies input into the fielding console PC, a batted ball may be registered as a hit even when time B is less than B1. For example, a hit may be declared when a batted ball quickly reaches a ceiling zone, a lower wall safe zone, or an upper or middle row wall zone (in other words, beyond the reach of the fielding team). Again, the magnitude of the hit is determined by the value Z and the value of B.

It is the goal of the fielding team to relay the ball quickly to a favorable field zone, thereby controlling Z and minimizing B. This is accomplished by either allowing the batted ball to strike a favorable wall or ceiling field zone naturally, or by fielding a batted ball and throwing it against an appropriate wall zone or the home zone within B1 seconds.

Accordingly, if the ball is hit into fair territory and fielded, it is then thrown to an appropriate wall zone (either to the home zone or one of the lower wall zones that have been designated as an out zone by the fielding team via the fielding console PC).

As previously mentioned, the game may employ three rows of wall zones, referred to as upper, middle and lower wall zones. Each row is divided into ten distinct fair sensory zones and two foul zones. Of the ten lower fair zones, some are designated as out zones (zones that register an out if penetrated by ball within B1 seconds) via the fielding team console while the majority are safe zones (zones that register a hit if penetrated by a batted ball). The number of out zones allowed a fielding team depends on the number of players on the fielding team, as follows:

1 player—4 out zones
2 players—3 out zones
3 players—2 out zones
4 or more players—1 out zone Additionally, the home zone is always another out zone. The reduction of out zones as the number of players increases tends to eliminate the advantage of having more players in the field.

After microprocessor MP registers the outcome, scoreboard SB can be updated. Thereafter the players review the automatic scoring and make changes, if necessary, through the consoles PC and BC. The scoreboard can provide as much information as necessary or desired. The display can show: result of the last batted ball (single, double, triple, home run, foul, or out); result of the last pitch (ball, strike, or balk); current game information (score, number of hits per team, inning, number of outs, pitching count); outfield depth (deep, normal, short); outfield alignment (shift left, shift right, normal, guard the lines); infield depth (normal, in, double play); bases occupied by imaginary runners (first, second, third, none); and any other relevant information. At the time of scoring, visual and audible effects can be provided through input/output device IO. For example, optical feedback (flashing lights, multiple colored lights, computer graphics, video images, etc.) and sound effects (bells, whistles, music, heckling, applause, cheering, umpire calls, etc.) can be included. In addition, a printer can provide a hard copy of the game results and individual player statistics.

If the pitch is not hit by batter BT, the players review the automatic scoring and make changes, if necessary, via the batter or fielding consoles BC or PC. Such adjustments may be necessary where it is ambiguous whether a pitch is to be counted as a ball, strike, etc. After such adjustments play can resume.

If the ball is hit into foul territory, zone detection means 14 (FIG. 4) register the same through microprocessor MP.

The game continues according to normal baseball rules until either: a. nine innings have been completed; b. a winner has been determined; c. agreed upon time or innings have expired; d. players decide to quit. Objectives of the Batting Team:

The batting team attempts to hit the pitched ball as sharply as possible so that the ball:

(A) penetrates a ceiling zone, or;

(B) penetrates an upper or middle wall zone, or;

(C) penetrates a lower wall safe zone (a zone not designated as an out zone by the fielding team via the fielding team console), or;

(D) cannot be fielded cleanly by the opposing team and thrown through an out zone within B1 seconds The outcome of Events C and D will always be a hit. However, the outcome of Events A and B will depend upon the value of B, the value of Z, and, in some cases, the defensive positioning of imaginary outfielders via the fielding team console.

Hits result in baserunners, baserunners result in runs, and runs ultimately result in victory.

Objectives of the Fielding Team:

The objective of the fielding team is to prevent the opposing team from scoring and to secure enough outs (usually three) so that they may take their turn at bat and score enough runs to win the game. The fielding team would prefer to secure outs through strike outs. But since a strike out is not always possible, the fielding team strives to have the batter hit a ball that:

(A) does not penetrate a ceiling zone, an upper wall zone or a middle wall zone, or if it does, it does so with little or no force, or;

(B) can be caught in flight by a member of the fielding team, or;

(C) can be fielded by a member of the fielding team and thrown into one of the designated out zones within B1 seconds, or;

(D) naturally penetrates an out zone within B1 seconds.

It is to be appreciated that various modifications may be implemented with respect to the above described embodiment. For example, the various steps performed by the microprocessor may be supplemented or amended to execute a different number or type of step. Alternatively, the steps can be performed in a different sequence. Furthermore, the number of ball sensing field zones can be increased or decreased in different embodiments. Also, the number of input/output devices can be changed depending upon the desired sophistication of the system. Additionally, the system can be changed to have a different response or no response to the speed of the ball after its second passing through passage zone "A" toward a ball sensing field zone. Also the size and the configuration of a room can be altered depending upon the number of players, the available room, etc. In addition, placement of the time-out and pitch buttons can be altered, and such buttons may be eliminated in certain embodiments. Likewise, playing rules may be added, deleted, updated or changed according to the chosen embodiment and player preferences.

Obviously, many modifications and variations of the present invention are possible in light of the above teachings. It is, therefore, to be understood that within the scope of the appended claims, the invention may be practiced otherwise than as specifically described.

I claim:

1. An apparatus for playing a baseball game played on a playfield having a ball pitching position and a batting position placed therein, comprising a ball detection means located in a ball passage zone between said pitching position and said batting position for providing a ball passage signal in response to passage of said ball through a ball passage zone:

a plurality of field zones placed about the perimeter of said playfield, each said field zone having ball intercept detecting means positioned for intercepting a ball and providing in response to said interception a signal indicating the position of a ball entering said zone, said signal corresponding to a position indicating a hit, foul or out; and scoring means coupled to said intercept detecting means for registering a hit, foul or out in response to said, said scoring means including:

timing means for indicating the elapsed time between a ball passing through said ball passage zone and interception of a ball by said ball intercept detecting means to provide a speed signal, said scoring means being operable to indicate a score in response to said speed signal.

2. A baseball game apparatus according to claim 1 wherein said scoring means is operable to score a hit or an out in response to whether said speed signal is within or outside, respectively, a predetermined range.

3. A baseball game apparatus according to claim 2 comprising:

a ball strike detector means located in a strike zone between said ball detection means and said batting position for detecting the presence of a ball or bat therein and providing a strike signal in response to said ball or bat traversing said strike zone, said scoring means being operable to register a strike in response to said strike signal being followed by an absence of a passage signal for a predetermined interval of time.

4. A baseball game apparatus according to claim 3 further comprising:

said pitch switch located near pitching position and coupled to said scoring means for scoring a balk or ball in response to actuation of said pitch switch followed by the absence of said a ball passing through said strike zone for a given period of time.

5. A baseball game apparatus according to claim 4 wherein said zone detection means comprises:

a first plurality of vertical detectors; and a second plurality of horizontal detectors located at a greater elevation than said vertical detectors.

6. A baseball game apparatus according to claim 5 wherein said scoring means is manually operable to change its scoring and to change the significance of interception of said ball by individual ones of said ball sensing field zones, to simulate repositioning of fielders.

7. A baseball game apparatus according to claim 6 wherein said scoring means comprises:

a fielding console located near said pitching position; and a batting console located near said batting position, said console being manually operable to set initials strategies.

8. A baseball game apparatus according to claim 7 further comprising:

A home zone located near said batting position for intercepting a ball and providing in response thereto a home zone signal, said scoring means being operable to register a pitch as a ball in response to said home zone signal preceded by actuation of said pitch switch by a batter.

9. A baseball game apparatus according to claim 8 further comprising:

a time-out switch coupled to said scoring means for delaying game play.

10. A baseball game apparatus according to claim 2 wherein said scoring means comprises:

processing means for responding to said passage and said field zone signals;

memory means coupled to said processing means for storing instructions for said processing means; and output means coupled to said processing means for providing a visual indication of the scoring registered by said processing means.

11. A baseball game apparatus according to claim 5 wherein said vertical and horizontal detectors comprise:

a spaced plurality of light sources for producing a plurality of light beams, said beams being located in horizontal and vertical planes for said horizontal and vertical detectors, respectively; and a spaced plurality of light sensors each corresponding with a different one of said light sources for producing an interrupt signal in response to said ball interrupting one of said light beams.

12. A baseball game apparatus according to claim 11 wherein said light beams are arranged in a grid in at least one of said vertical planes.

13. A baseball game apparatus according to claim 12 wherein said light beams that are located in said vertical planes are orthogonal and are located in one of two orthogonal planes.

14. A baseball game apparatus according to claim 13 wherein said light beams that are in said horizontal planes are coplanar and arranged in a grid.

15. A baseball game apparatus according to claim 11 wherein said light sensors are grouped into a plurality of groups corresponding to a plurality of zones.

16. A baseball game apparatus according to claim 15 wherein each one of said plurality of zones intersects with at least another one of said zones.

* * * * *